US006578412B2

(12) United States Patent
Konno et al.

(10) Patent No.: US 6,578,412 B2
(45) Date of Patent: Jun. 17, 2003

(54) ENGINE OIL DEGRADATION JUDGING METHOD AND APPARATUS

(75) Inventors: Atsushi Konno, Fujisawa (JP); Syunji Matsumoto, Kawasaki (JP); Yasutaka Ishibashi, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/096,113

(22) Filed: Mar. 13, 2002

(65) Prior Publication Data

US 2002/0129645 A1 Sep. 19, 2002

(30) Foreign Application Priority Data

Mar. 16, 2001 (JP) ..... 2001-077304

(51) Int. Cl.[7] ..... G01M 19/00
(52) U.S. Cl. ..... 73/118.1
(58) Field of Search ..... 73/35.02, 116, 73/117.2, 118.1, 53.05; 340/450, 450.3, 438, 441, 451

(56) References Cited

U.S. PATENT DOCUMENTS 4,796,204 A * 1/1989 Inoue ..... 123/196 S
5,933,016 A * 8/1999 Kauffman et al. ..... 324/698
6,253,601 B1 * 7/2001 Wang et al. ..... 340/438
6,327,900 B1 * 12/2001 Mc Donald et al. ..... 701/30
6,421,588 B1 * 7/2002 Janata ..... 340/438
6,513,367 B2 * 2/2003 Bondarowicz et al. ..... 73/53.05
6,513,368 B2 * 2/2003 Bondarowicz et al. ..... 73/53.05

* cited by examiner

*Primary Examiner*—Hezron Williams
*Assistant Examiner*—Corey D. Mack
(74) *Attorney, Agent, or Firm*—Rabin & Berdo, PC

(57) ABSTRACT

A method of determining a degree of oil degradation in the diesel engine depending on an injection end point in such an injection way as to cause the injection 0end point to be earlier that a specific point ($T_B$) and depending on the injection amount after the specific point and the injection end point in such an injection way as to cause the injection end point to be later than the specific point. In every fuel injection, it is judged whether the injection end point is set before or after the specific point, and a current injection degradation value is obtained by using a corresponding map. A cumulative added value is obtained to judge the oil degradation.

5 Claims, 6 Drawing Sheets

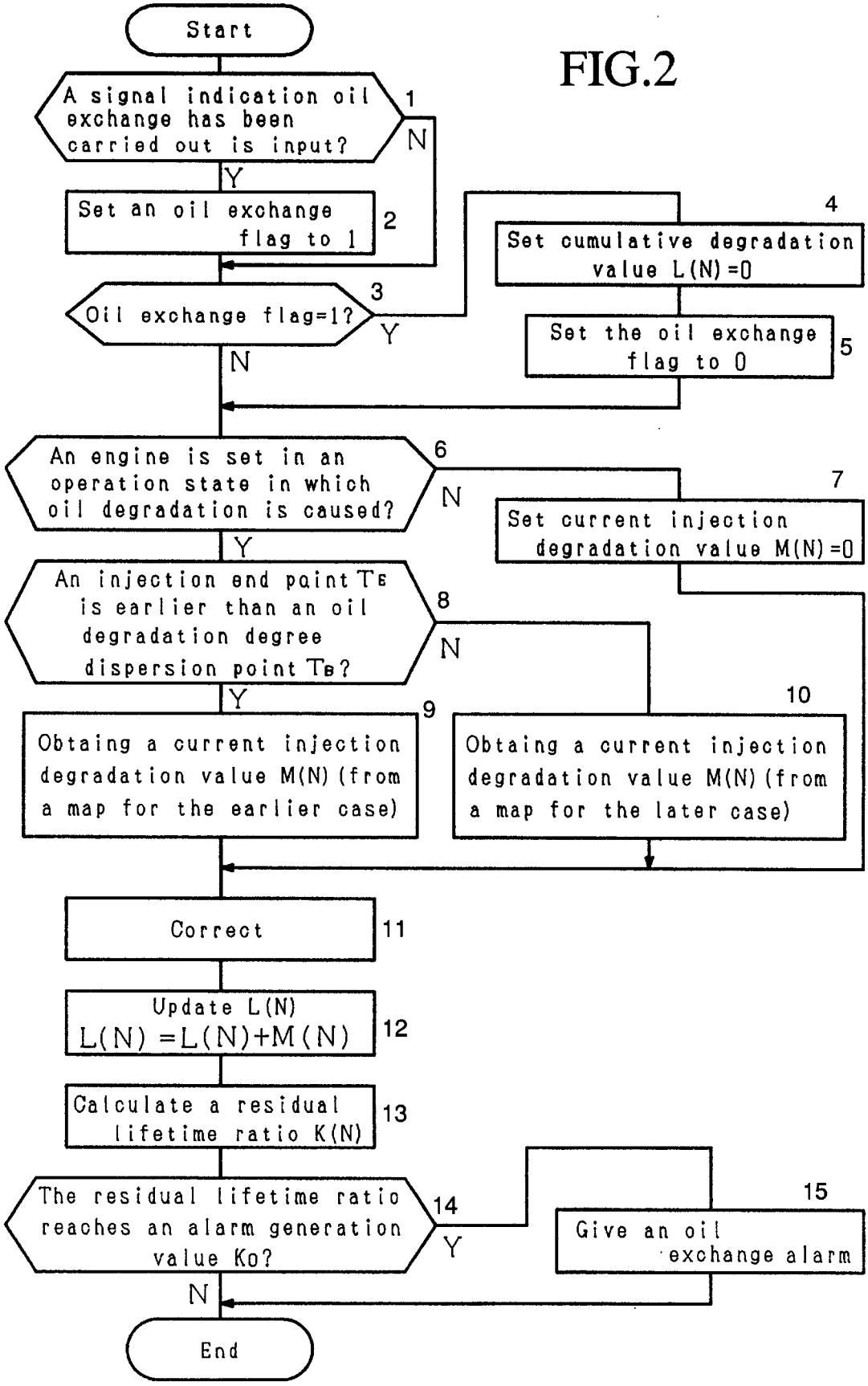
FIG.2
Start
A signal indication oil exchange has been carried out is input?
1
N
Y
Set an oil exchange flag to 1
2
Oil exchange flag=1?
3
Y
N
Set cumulative degradation value L(N)=0
4
Set the oil exchange flag to 0
5
An engine is set in an operation state in which oil degradation is caused?
6
N
Y
Set current injection degradation value M(N)=0
7
An injection end point TE is earlier than an oil degradation degree dispersion point TB?
8
N
Y
Obtaing a current injection degradation value M(N) (from a map for the earlier case)
9
Obtaing a current injection degradation value M(N) (from a map for the later case)
10
Correct
11
Update L(N)
L(N) =L(N)+M(N)
12
Calculate a residual lifetime ratio K(N)
13
The residual lifetime ratio reaches an alarm generation value Ko?
14
Y
N
Give an oil exchange alarm
15
End $T_B$ Oil degradation degree dispersion point $T_{BE}$ Injection period after oil degradation degree dispersion point M Current injection degradation value

| | | TE (Injection end point) | | | | | |
|---|---|---|---|---|---|---|---|
| | | TE1 | TE2 | TE3 | TE4 | ---- | ---- |
| QBE (Injection period after oil degradation degree dispersion point) | QBE1 | M11 | M12 | M13 | M14 | ---- | ---- |
| | QBE2 | M21 | M22 | M23 | M24 | ---- | ---- |
| | QBE3 | M31 | M32 | M33 | M34 | ---- | ---- |
| | QBE4 | M41 | M42 | M43 | M44 | ---- | ---- |
| | QBE5 | M51 | M52 | M53 | M54 | ---- | ---- |
| | QBE6 | M61 | M62 | M63 | M64 | ---- | ---- |
| | ⋮ | ⋮ | | | | | |
| | ⋮ | ⋮ | | | | | |

ENGINE OIL DEGRADATION JUDGING METHOD AND APPARATUS

FIELD OF THE INVENTION

The present invention relates to an engine oil degradation judging method and apparatus for a diesel engine.

BACKGROUND OF THE INVENTION

When a diesel engine is used, foreign substances are mixed with an engine oil with the passage of time. The foreign substances mainly include soot generated by the combustion of a fuel in the engine. When the amount of the soot contained in the engine oil is increased, lubricating properties are deteriorated and the internal wall of the engine or the like is damaged. More specifically, the performance of the engine oil is deteriorated by the mixture of the soot. Therefore, it is necessary to exchange the engine oil at a proper time.

In most cases, conventionally, the exchange of the engine oil is determined to be carried out when a running distance reaches a predetermined value (for example, 5000 Km). In a conventional diesel engine which does not have an electronic control type, there has been known a correlation between each of an engine speed, an injection pressure, a load (a fuel injection amount), an engine oil temperature and the like, and the amount of generated soot.

Accordingly, it is possible to estimate the amount of the soot contained in the engine oil depending on factors based on the correlation. The running distance at which the engine oil is to be exchanged is determined based on such an estimation.

For other techniques for giving a notice of the time that the engine oil is to be exchanged, a running distance and a load are monitored to give a notice, a degradation weighting factor is determined depending on an engine oil temperature and an engine speed and a running distance is corrected based on the factor to give a notice (Japanese Patent Application Laid-Open No. Sho 59-43299), a notice is given in consideration of the content of soot, the degree of an increase in a viscosity, a decrease in a total base number and the like (Japanese Patent Application Laid-Open No. 2000-227018).

However, the conventional art has the following problems.

For a first problem, the amount of the generated soot is calculated based on the correlation with the engine speed or the like and the calculation is not very accurate. In consideration of safety, therefore, a shorter distance than a running distance corresponding to the amount of generation thus calculated is determined as a running distance at which an oil is to be exchanged.

More specifically, the oil exchange is to be carried out earlier. Therefore, the engine oil is discarded irrespective of the residual lifetime of the engine oil which can be still used. Consequently, the resources are consumed wastefully and a cost is increased.

For a second problem, a diesel engine which is electronically controlled by a computer has a small correlation between an engine speed, an injection pressure or the like and the amount of the generated soot.

The calculation of the amount of the generated soot with the use of the conventional correlation does not correspond to actual conditions.

In a conventional diesel engine which is not controlled electronically, an injection pressure, an injection timing and the like are spontaneously determined corresponding to the mechanical operating situations of the engine (for example, whether the engine speed is high or low, and the like). Therefore, there is a correlation with the amount of the generated soot. In the electronic control, however, the injection pressure or the like is not always restrained by the mechanical operating situations of the engine but is optionally controlled depending on operating conditions. Therefore, the conventional correlation is not recognized.

The present invention has an object to solve the problems described above.

SUMMARY OF THE INVENTION

The first object of the invention is to be able to judge degradation in an engine oil more accurately than that in the conventional art. The present invention is based on the newly found phenomenon (correlation) in which the amount of soot generation in the diesel engine can be obtained more precisely than that in the conventional art.

The second object of the invention is to judge the oil degradation based on the amount of soot accumulated in the engine oil and to be able to use the engine oil until the lifetime of the oil is almost completed (the resources can be utilized effectively). Conventionally, the oil exchange has been carried out earlier based on a running distance. In many cases, therefore, the oil which can be still used is discarded.

The third object of the invention is to decrease the number of times of the oil exchange and to enhance maintenance properties with a reduction in a cost.

The fourth object of the invention is to inform a driver of a time that the oil exchange is to be carried out, displaying an oil exchange alarm on the display device of judgement result in response to an oil degradation decision output.

In order to solve the aforesaid subjects, the present invention provides a judging method of engine oil degradation to be carried out by obtaining an amount of soot generation in a diesel engine, comprising the steps of, calculating oil degradation value in the current injection by the injection end point in the case of the injection end point is set before the predetermined oil degradation degree dispersion point, calculating oil degradation value in the current injection by the injection end point as well as an injection amount after an oil degradation degree dispersion point in the case of the injection end point is set after the predetermined oil degradation degree dispersion point and accumulating oil degradation value in the current injection, thereby oil degradation is judged.

Moreover, the present invention provides an engine oil degradation judging apparatus in which a signal from a sensor for detecting a signal required for obtaining an injection end point is inputted, comprising a map storage portion for storing at least a first map for obtaining oil degradation value in the current injection by the injection end point in the case of the injection end point is set before a predetermined oil degradation degree dispersion point and a second map for obtaining oil degradation value in the current injection by the injection end point as well as an injection amount after an oil degradation degree dispersion point in the case of the injection end point is set after the predetermined oil degradation degree dispersion point, a current injection degradation value portion for obtaining an oil degradation value in the injection from the first or second map in every fuel injection and for storing the same value. a cumulative degradation value portion for cumulatively adding the value of the current injection degradation value portion to obtain a cumulative degradation value every time the injection is ended and for storing the same value, and an oil degradation judging portion for judging oil degradation based on the cumulative degradation value, thereby a judgement signal is output.

The oil degradation judging portion of the engine oil degradation judging apparatus includes a residual lifetime ratio portion for calculating a residual lifetime ratio representing a rate of a difference between a maximum allowable degradation value and a cumulative degradation value to a maximum allowable degradation value and for storing the residual lifetime ratio, and an oil exchange alarm generation value portion for storing a predetermined oil exchange alarm generation value for deciding whether or not an oil exchange alarm is given as compared with the residual lifetime ratio.

For an apparatus to be operated in response to the decision output of the engine oil degradation judging apparatus, furthermore, it is also possible to comprise a display device of judgement result to display judgement result including an oil exchange alarm in response to a judgement output.

BRIEF DESCRIPTION OF THE DRAWING

FIG. 2 is a flow chart for explaining the operation of the engine oil degradation judging apparatus according to the present invention.

BEST MODE FOR PRACTICING THE INVENTION

The present invention has been made based on the discovery of a new phenomenon (correlation) related to the degree of degradation of the engine oil (the amount of soot generation). Accordingly, the phenomenon will be first described before the detailed description of a preferred embodiment of the invention. The new phenomenon has been found by the inventor of the present invention.

Figure 6:
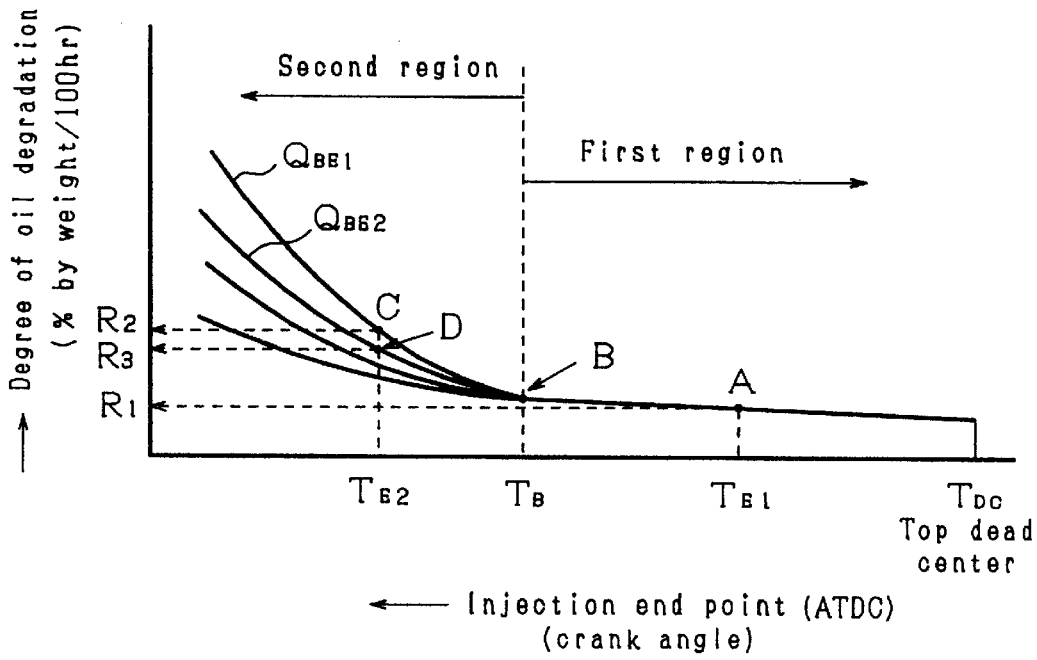
FIG. 6 is a chart related to the degree of oil degradation which is the basis of the present invention.

FIG. 6 is a chart related to the degree of oil degradation which is the basis of the present invention. An ordinate axis indicates the degree of oil degradation, wherein a unit of % by weight represents the amount of soot contained in an engine oil when a diesel engine is operated for 100 hours.

An abscissa axis indicates an injection end point $T_E$, wherein a crank angle is used as a unit (ATDC means "after top dead center"). A top dead center T DC is positioned in a right part of the abscissa axis and an arrow in the abscissa axis is drawn in a direction of an origin. Therefore, a point ($T_{E1}$, $T_{E2}$ or the like) closer to the origin than the top dead center Too means a point in a process in which a piston is being lowered.

Description will be given to the meaning of a point A on a curve which has a value of $T_{E1}$ in the abscissa axis and a value of $R_1$ in the axis ordinate axis. This implies the degree of degradation with $R_1$ % by weight of soot contained in the engine oil when the fuel injection has an injection end point $T_{E1}$ and is carried out for 100 hours.

$T_B$ denotes a point referred to as an "oil degradation degree dispersion point". When the injection is to be completed at a later time than that time (a point of a second region in FIG. 6), the degree of oil degradation is not determined almost univocally depending on the injection end point $T_E$ but is dispersed to have various values based on an injection amount $Q_{BE}$ after the oil degradation degree dispersion point which will be described below with reference to FIG. 7. Thus, while the oil degradation degree dispersion point $T_B$ at which the degree of oil degradation starts to be dispersed is obtained experimentally, various values can be obtained depending on the type of an engine oil to be used, the type of a diesel engine to be used, or the like.

For example, a point C is set on a curve having an injection amount $Q_{BE1}$ after an oil degradation degree dispersion point. The point C implies that the engine oil has the degree of degradation at which $R_2$ % by weight of soot is contained therein when such an injection way as to have the injection amount $Q_{BE1}$ after an oil degradation degree dispersion point and an injection end point $T_{E2}$ is carried out for 100 hours. Moreover, a point D on a curve having an injection amount $Q_{BE2}$ after an oil degradation degree dispersion point implies that the engine oil has the degree of degradation at which $R_3$ % by weight of soot is contained therein when such an injection way as to have the injection amount $Q_{BE2}$ after an oil degradation degree dispersion point and an injection end point $T_{E2}$ is carried out for 100 hours.

On the other hand, when such an injection way as to compete the injection at an earlier point (a point of a first region in FIG. 6) then the oil degradation degree dispersion point $T_B$, the oil degradation degree is determined almost univocally depending on the injection end point $T_E$.

The summary of the new phenomenon is as follows.

(1) When the injection end point $T_E$ is set in the first region (which is earlier than the oil degradation degree dispersion point $T_B$), the degree of oil degradation is determined depending on the injection end point $T_E$.

(2) When the injection end point $T_E$ is set in a second region (which is later than the oil degradation degree dispersion point $T_B$), the degree of oil degradation is determined depending on the injection end point $T_E$ and the injection amount $Q_{BE}$ after an oil degradation degree dispersion point.

Figure 7:
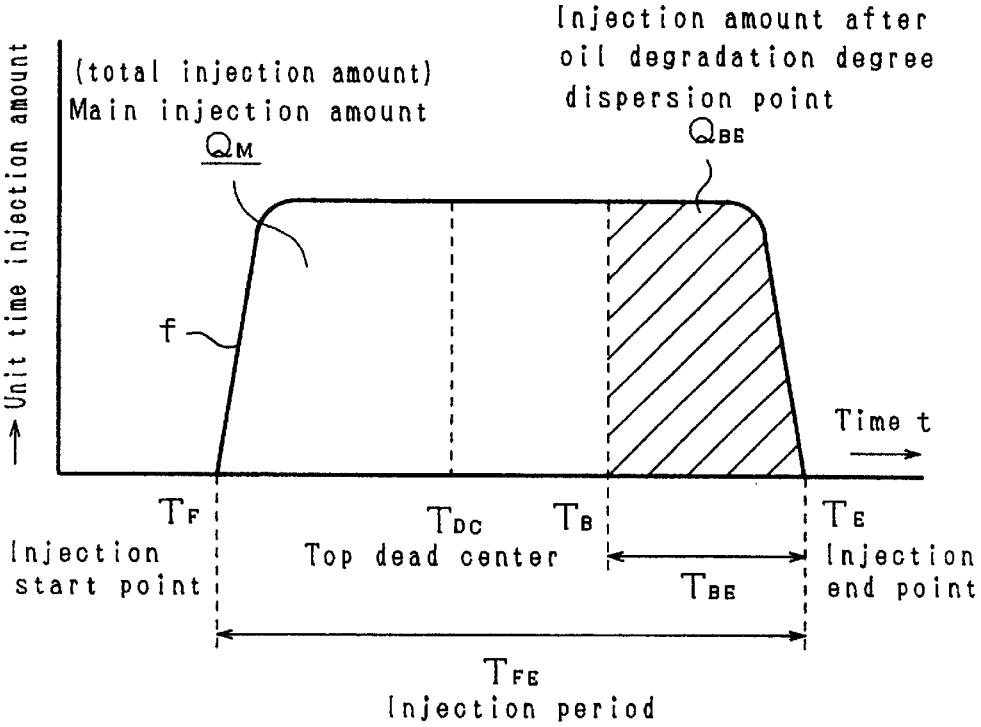
FIG. 7 is a chart for explaining the meaning of terms used in the present invention.

FIG. 7 is a chart for explaining the meaning of terms used in the present invention. The reference numerals correspond to those of FIG. 6, and $T_F$ represents an injection start point, $T_{FE}$ represents an injection period, $T_{BE}$ represents an injection period after an oil degradation degree dispersion point, and $Q_M$ represents a main injection amount. An abscissa axis t indicates a time, an ordinate axis indicates a unit time injection amount, and a curve f indicates a change in a unit time injection amount. In FIG. 7, a movement is carried out rightwards over the abscissa axis with the passage of time (a direction of the passage of time is reverse to that of the abscissa in axis FIG. 6).

An example of the injection shown in the chart is as follows. In the example of the injection, the injection is started at a time $T_F$ before the top dead center $T_{DC}$ (at which a piston is being raised) and the injection is ended at a later time $T_E$ than the oil degradation degree dispersion point $T_B$ after the top dead center $I_{DC}$.

The injection period $T_{FE}$ includes a period from the injection start point $T_F$ to the injection end point $T_E$ and a total injection amount for that period is a main injection amount $Q_M$. The injection period $T_{BE}$ after an oil degradation degree dispersion point includes a period from the oil degradation degree dispersion point $T_B$ to the injection end point $T_E$ and an injection amount for that period is represented by an injection amount $Q_{BE}$ after an oil degradation degree dispersion point. When the injection end point $T_E$ is later than the oil degradation degree dispersion point $T_B$, the injection amount $Q_{BE}$ after an oil degradation degree dispersion point influences the degree of oil degradation.

An embodiment of the present invention will be described below in detail with reference to the drawings.

Figure 1:
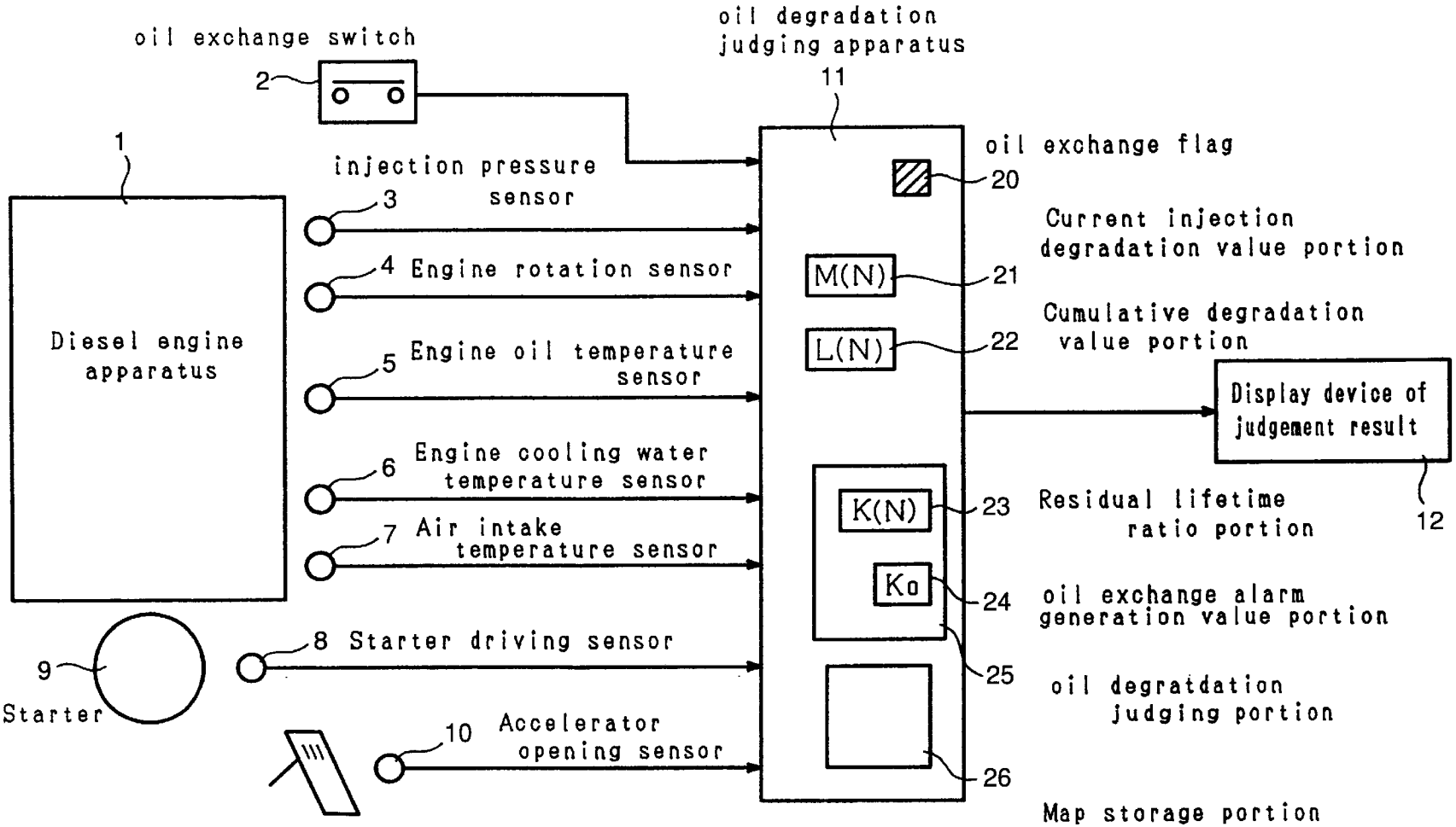
FIG. 1 is a diagram showing an engine oil degradation judging apparatus according to the present invention.

FIG. 1 is a diagram showing an engine oil degradation judging apparatus according to the present invention. In FIG. 1, the reference numeral 1 denotes a diesel engine apparatus, the reference numeral 2 denotes an oil exchange switch, the reference numeral 3 denotes an injection pressure sensor, the reference numeral 4 denotes an engine rotation sensor, the reference numeral 5 denotes an engine oil temperature sensor, the reference numeral 6 denotes an engine cooling water temperature sensor, the reference numeral 7 denotes an air intake temperature sensor, the reference numeral 8 denotes a starter driving sensor, the reference numeral 9 denotes a starter, the reference numeral 10 denotes an accelerator opening sensor, the reference numeral 11 denotes an oil degradation judging apparatus, the reference numeral 12 denotes a display device of judgement result, the reference numeral 20 denotes an oil exchange flag, the reference numeral 21 denotes a current injection degradation value portion, the reference numeral 22 denotes a cumulative degradation value portion, the reference numeral 23 denotes a residual lifetime ratio portion, the reference numeral 24 denotes an oil exchange alarm generation value portion, the reference number 25 denotes an oil degradation judging portion, and the reference numeral 26 denotes a map storage portion.

The diesel engine apparatus 1 comprises peripheral equipment such as a fuel injection device in addition to a diesel engine.

The oil exchange switch 2 serves to generate a signal indicating that the engine oil of the diesel engine apparatus 1 has been exchanged.

When the oil is exchanged, an operator turns ON the switch. When the switch is turned ON, the oil exchange flag 20 in the oil degradation judging apparatus 11 is set to "1" (set). The oil exchange switch 2 is an example of a means for generating a signal indicating that the oil has been exchanged. The signal can also be generated by another means. For example, after the oil is exchanged, the signal may be generated by pressing an accelerator pedal a predetermined number of times.

The starter driving sensor 8 serves to detect whether or not the starter 9 is being driven, and may be a sensor for detecting the presence of a current sent to the starter 9 or a sensor for detecting the rotation of the starter 9.

The oil degradation judging apparatus 11 comprises a CPU (central processing unit), a storage device and the like, and is constituted on a computer basis. In the oil degradation judging apparatus II, an oil degradation value is obtained for each fuel injection operation and is held in the current injection degradation value portion 21 based on a signal sent from the oil exchange switch 2 or each sensor, and a cumulative degradation value is obtained after the oil exchange is performed and is held in the cumulative degradation value portion 22. The oil degradation judging portion 25 judges whether or not the cumulative degradation value reaches a predetermined value.

The judgement may be carried out depending on whether the cumulative degradation value reaches a predetermined maximum allowable degradation value or may be carried out be calculating a residual lifetime ratio (=a rate of a difference between the maximum allowable degradation value and the cumulative degradation value to the maximum allowable degradation value) and judging whether or not the residual lifetime ratio is decreased to a predetermined value. The residual lifetime ratio portion 23 serves to calculate and store the residual lifetime ratio, and the oil exchange alarm generation value portion 24 serves to store an oil exchange alarm generation value $K_O$ to be the predetermined value.

The map storage portion 26 serves to store a map (maps shown in FIGS. 5, 8 and 9 and the like which will be described below) for calculating an oil degradation value and the like.

The display device of judgement result 12 serves to display a result of judgement in the oil degradation judging portion 25, and displays that oil degradation has reached a limit or that the oil exchange is required.

FIG. 2 is a flow chart for explaining the operation of the engine oil degradation judging apparatus according to the present invention.

Step 1—It is judged whether or not a signal indicating that the oil exchange has been carried out is input by means of the oil exchange switch 2. If the signal is not input, a process proceeds to a step 3.

Step 2—If the signal is input, the oil exchange flag 20 is set to "1" (set).

Step 3—It is judged whether or not the value of the oil exchange flag 20 is set to "1".

Step 4—If the value is set to "1", the oil exchange has just been carried out so that the engine oil is new. Accordingly, a cumulative degradation value L(N)=0 is set (N indicates the number of times of injections and so forth).

Step 5—When the cumulative degradation value L(N)=0 is set, the value of the oil exchange flag 20 is set to "0" (reset).

Step 6—It is judged whether or not the diesel engine is set in an operation state for generating oil degradation. More specifically, it is judged whether or not an injection amount is greater than zero, an engine failure is not caused and an engine starting mode is not set (=i.e., the operation state is a state in which a fuel is injected and the engine is normally rotated).

Step 7—In the case of the operation state in which the oil degradation is not occurring (example: if the injection amount=0 is set, the soot is not generated and the oil is not degraded), a current injection degradation value M(N)=0 is set.

Step 8—In the case of the operation state in which the oil degradation is occurring, it is judged whether or not the injection end point $T_E$ in the current fuel injection is earlier than the oil degradation degree dispersion point $T_B$. The oil degradation degree dispersion point $T_B$ has a predetermined fixed value (the value is varied depending on the type of the diesel engine or the type of the engine oil). The injection end point $T_E$ can be obtained as shown in FIG. 3, for example.

Figure 3:
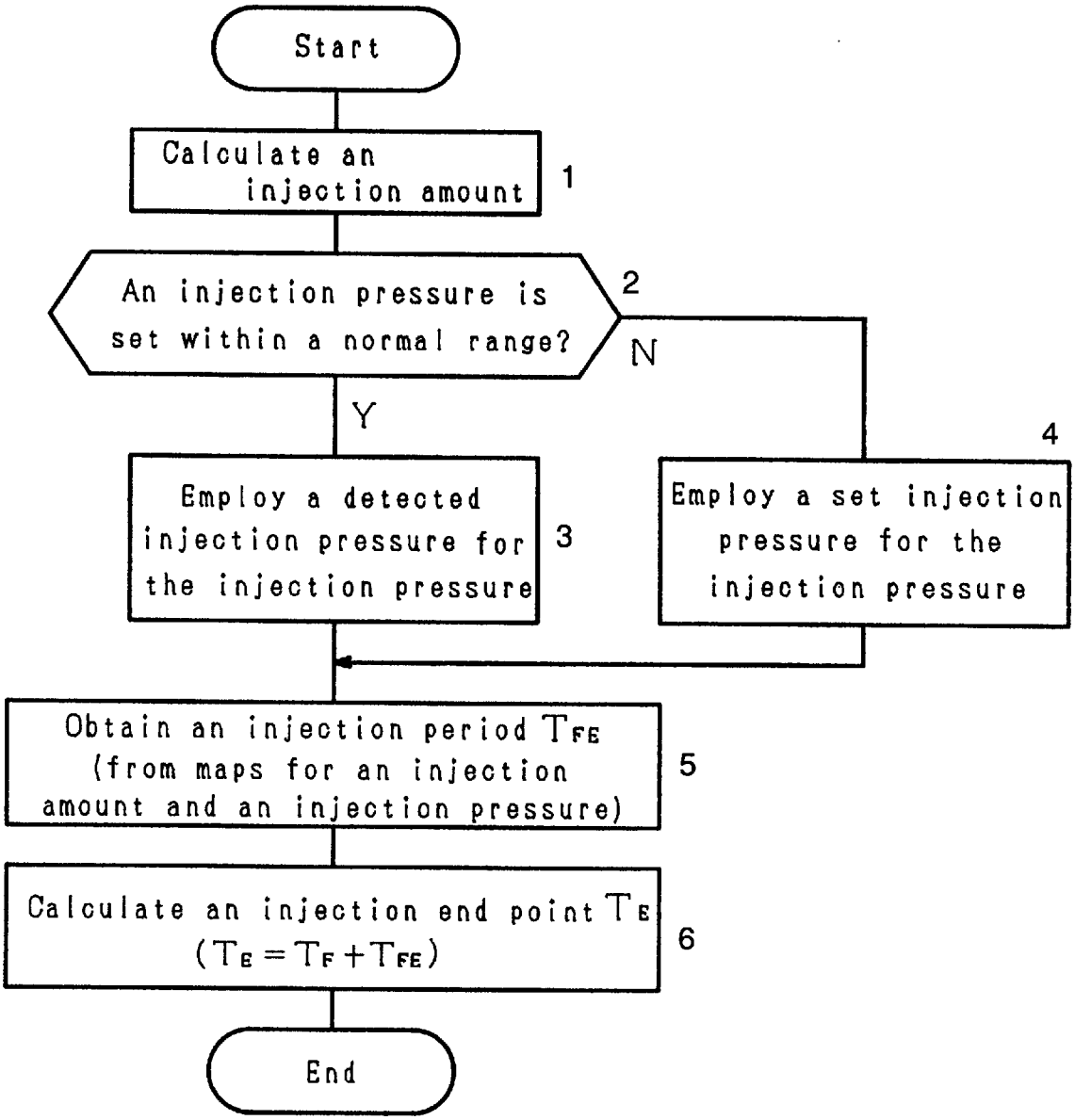
FIG. 3 is a flow chart showing the way of obtaining an injection end point.

Step 1 in FIG. 3—First of all, the injection amount is calculated. The injection amount is obtained based on an accelerator opening, an engine speed and the like according to the known conventional art. The accelerator opening is detected by the accelerator opening sensor 10 in FIG. 1 and the engine speed is detected by the engine speed sensor 4.

Step 2 in FIG. 3—It is judged whether or not the injection pressure detected by the injection pressure sensor 3 has a value within a normal range. The judgement is carried out as compared with an upper limit value and a lower limit value which define the normal range.

Step 3 in FIG. 3—When the injection pressure thus detected has a value within a normal range, the detected injection pressure is employed as an injection pressure to be used in a step 5 of FIG. 3.

Step 4 in FIG. 3—When the injection pressure does not have a value within the normal range (when the injection pressure sensor 3 has a failure, such a value is obtained), a preset injection pressure is employed as the injection pressure to be used in the step 5. The set injection pressure is determined to have a value representing such a normal injection pressure.

Figure 5:
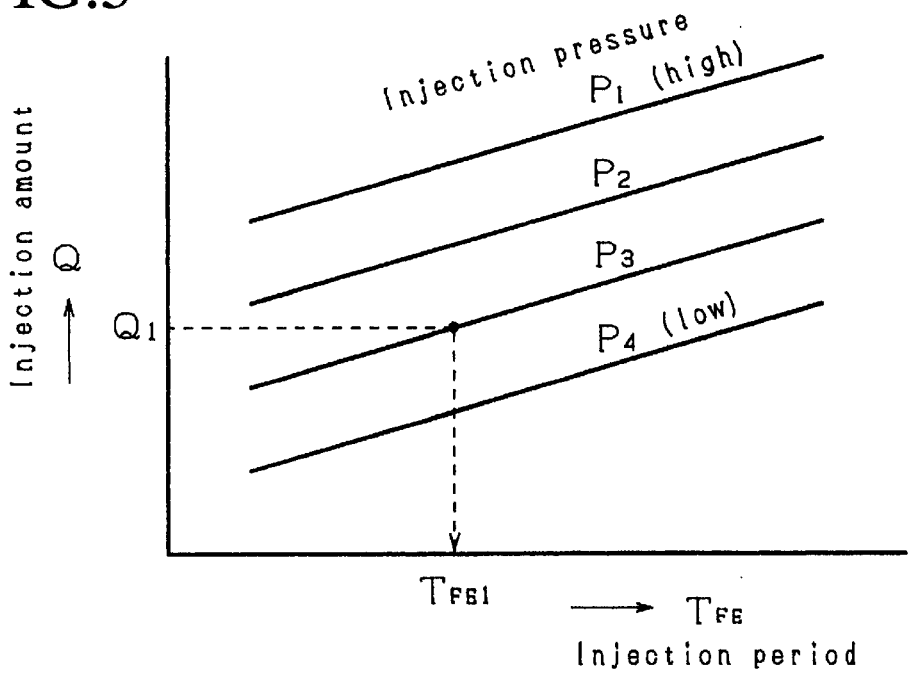
FIG. 5 is a map showing the relationship between an injection amount, an injection pressure and an injection period.

Step 5 in FIG. 3—An injection period is obtained by a map for calculating an injection period from an injection amount and an injection pressure. FIG. 5 is a map showing the relationship between the injection amount, the injection pressure and the injection period. $P_1$ to $P_4$ denote an injection pressure having a relationship of $P_1>P_2>P_3>P_4$. For example, with an injection amount $Q_1$ and an injection pressure $P_3$, an injection period $T_{FE1}$ is obtained as shown in a dotted arrow.

Step 6 in FIG. 3—An injection end point $T_E$ is obtained. The injection start point $T_F$ can be previously known and can be obtained by adding the injection period $T_{FE}$ thereto. (The description of the way of calculating the injection end point $T_E$ in FIG. 3 has been completed to return to FIG. 2).

Step 9—When the injection end point $T_E$ is earlier than the oil degradation degree dispersion point $T_B$ (in the case of the first region in FIG. 6), a current injection degradation value is obtained by using a map to be utilized in the case where $T_E$ is earlier than $T_B$.

Figures 8, 9:
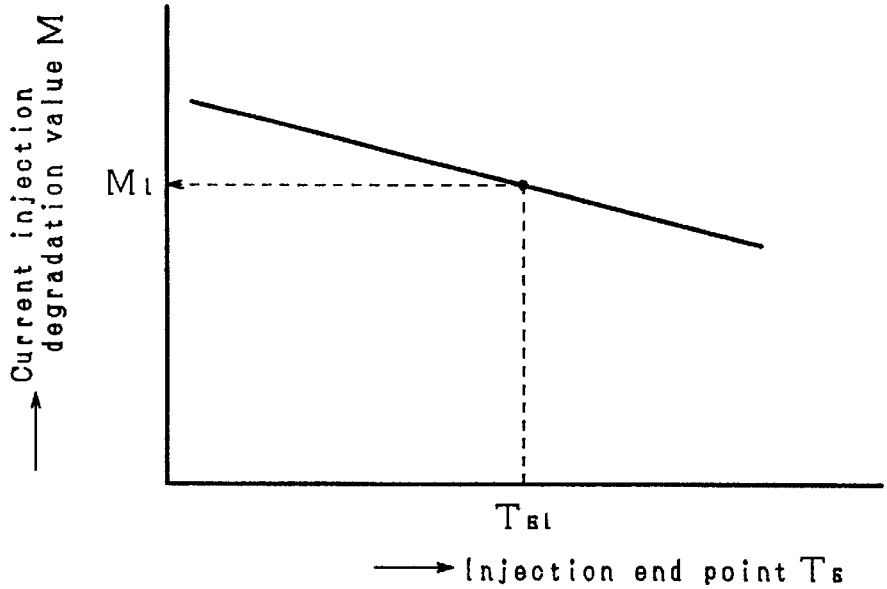
FIG. 8 is a map for calculating a current injection degradation value from an injection end point.
FIG. 9 is a map for calculating the current injection degradation value form the injection end point and the injection amount after an oil degradation degree dispersion point.

FIG. 8 is a map to be used in the case where $T_E$ is earlier than $T_B$, in which the current injection degradation value M is obtained from the injection end point $T_E$. For example, if the injection end point is set to $T_{E1}$, a current injection degradation value $M_1$ is obtained as shown in a dotted line.

Step 10—When the injection end point $T_E$ is later than the oil degradation degree dispersion point $T_B$ (in the case of the second region in FIG. 6), a current injection degradation value M is obtained by using a map to be utilized in the case where $T_E$ is later than $T_B$.

FIG. 9 is a map to be used in the case where $T_E$ is later than $T_B$, in which the current injection degradation value M is obtained from the injection end point $T_E$ and an injection amount after an oil degradation degree dispersion point $Q_{BE}$. For example, if an injection end point is set to $T_{E3}$ and an injection amount after an oil degradation degree dispersion point is set to $Q_{BE2}$, a current injection degradation value $M_{23}$ is obtained As is apparent from FIG. 7, there is a relationship of $T_E=T_B+T_{BE}$ and $T_B$ is a fixed value. Therefore, it is also possible to use a map having the $T_E$ portion replaced with $T_{BE}$ in place of the map in FIG. 9.

Figure 4:
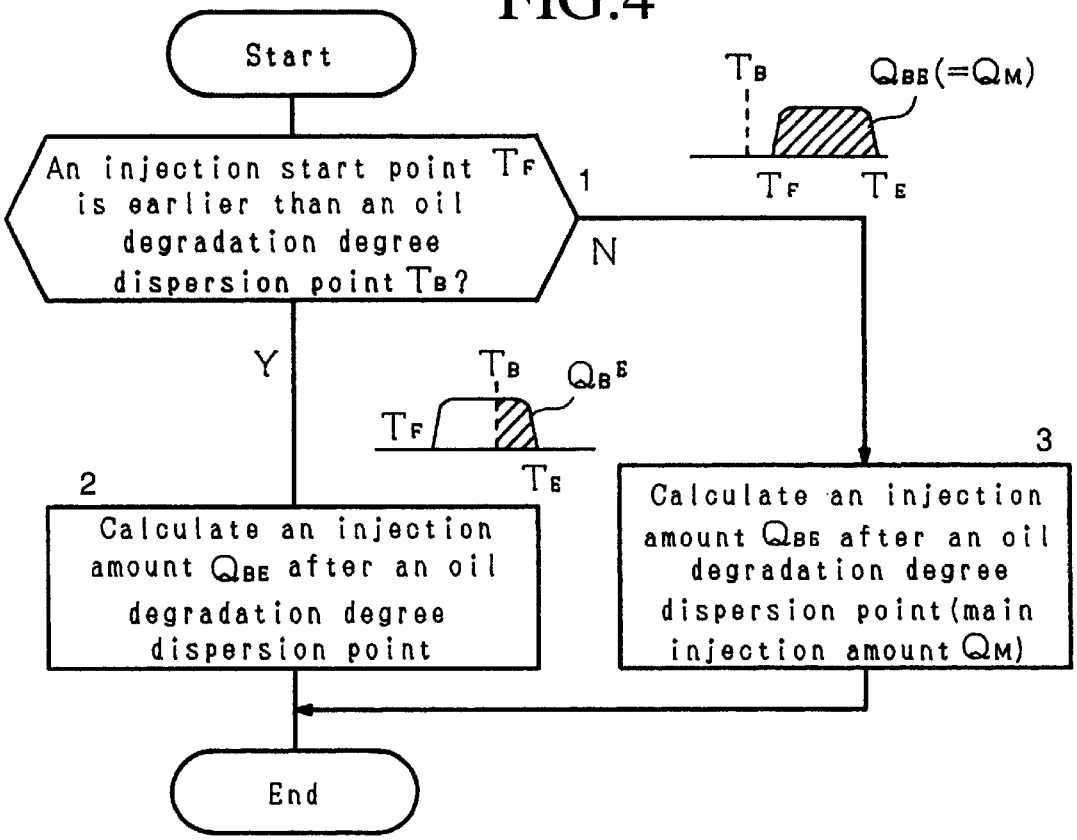
FIG. 4 is a flow chart showing the way of calculating an injection amount after an oil degradation degree dispersion point.

FIG. 4 is a flow chart showing the way of calculating the injection amount $Q_{BE}$ after an oil degradation degree dispersion point to be used in the step 9. At a step 1 in FIG. 4, it is judged whether or not the injection start point $T_F$ is earlier than the oil degradation degree dispersion point $T_B$.

The injection situation in the case where $T_F$ is earlier than $T_B$ is shown in the side of a path proceeding in a direction of YES. Therefore, the injection amount $Q_{BE}$ after an oil degradation degree dispersion point is obtained as an injection amount in a slant line portion after the oil degradation degree dispersion point $T_B$ at a step 2 in FIG. 4.

On the other hand, the injection situation in the case where $T_F$ is later than $T_B$ is shown in a path proceeding in a direction of NO. Therefore, the injection amount $Q_{BE}$ after an oil degradation degree dispersion point is obtained as an injection amount from the injection start point $T_F$ to the injection end point $T_E$ (that is, a main injection amount $Q_M$) in a step 3 of FIG. 4.

(Return to the explanation of FIG. 2).

Step 11—The degradation in the engine oil is also varied depending on a temperature. Therefore, a correcting process corresponding to a temperature is carried out. For example, correction factors corresponding to an engine oil temperature, an engine cooling water temperature and an air intake temperature are previously held in the form of a map and a correction factor is obtained in response to temperature detection signals sent from the engine oil temperature sensor 5, the engine cooling water temperature sensor 6 and the air intake temperature sensor 7 in FIG. 1, and the current injection degradation value M is multiplied by the correction factor, thereby carrying out the correction.

Step 12—The current injection degradation value M(N) is obtained and is subjected to the correcting process, and a cumulative degradation value L(N) obtained by integration is updated. More specifically, an operation of L(N)=L(N)+M(N) is carried out.

Step 13—Description will be given to an example in which the oil degradation judging portion 25 in FIG. 1 serves to calculate a residual lifetime ratio K(N) and to judge whether or not the residual lifetime ratio K is decreased to a predetermined oil exchange alarm generation value $K_0$ (as described above, it is also possible to employ such a structure as to judge whether or not the cumulative degradation value L(N) reaches a maximum allowable degradation value (if the cumulative degradation value is the maximum allowable degradation value or more, the engine oil is judged to be improper.). In that case, the contents of the operation in steps 13 to 15 are also varied depending on the maximum allowable degradation value).

At this step, the residual lifetime ratio K(N) is calculated. When the maximum allowable degradation value is represented by $L_{MAX}$, K(N) calculated by the following equation can be referred to as a residual lifetime ratio.

$$K(N)=[L_{MAX}-L(N)]/L_{MAX}$$

Step 14—It is examined whether or not the residual lifetime ratio K(N) is decreased to a preset oil exchange alarm generation vale $K_0$.

The oil exchange alarm generation value $K_0$ is set to 2% or 3% which is close to 0%, for example. Since it is preferable that an oil exchange alarm should be given slightly before the residual lifetime ratio K(N) has a value of 0%, the value of 0% is not set.

Step 15—When the oil exchange alarm generation value $K_0$ is reached, a signal is sent to the display device of judgement result 12 to give an oil exchange alarm.

What is claimed are:

1. A judging method of engine oil degradation to be carried out by obtaining an amount of soot generation in a diesel engine, comprising:

judging whether a fuel injection end point is set before or after a predetermined oil degradation degree dispersion point in every fuel injection operation to be performed;

calculating an oil degradation value in a current performed fuel injection operation by using the fuel injection end point when the fuel injection end point is set before the predetermined oil degradation degree dispersion point;

calculating an oil degradation value in the current performed fuel injection operation by using the fuel injection end point, as well as by using a fuel injection amount after the predetermined oil degradation degree dispersion point when the fuel injection end point is set after the predetermined oil degradation degree dispersion point; and accumulating the oil degradation value for the current performed fuel injection operation to thereby judge the oil degradation.

2. An engine oil degradation judging apparatus in which a signal from a sensor, for detecting a signal required for obtaining a fuel injection end point, is inputted, comprising:

a map storage portion for storing at least a first map that contains data for obtaining an oil degradation value for a current fuel injection operation based on a fuel injection end point when the fuel injection end point is set before a predetermined oil degradation degree dispersion point, and a second map that contains data for obtaining the oil degradation value for the current fuel injection operation based on the fuel injection end point, as well as on a fuel injection amount after the predetermined oil degradation degree dispersion point, when the fuel injection end point is set after the predetermined oil degradation degree dispersion point;

a current injection degradation value portion for obtaining the oil degradation value for the fuel injection operation from data contained in the first map storage portion or the second map storage portion for every fuel injection operation performed and for storing the same value;

a cumulative degradation value portion for cumulatively adding the oil degradation value of the current injection degradation value portion to obtain a cumulative degradation value every time the fuel injection operation ends and for storing the same value; and an oil degradation judging portion for judging oil degradation based on the cumulative degradation value obtained by the cumulative degradation value portion so that a judgement signal may be outputted.

3. The engine oil degradation judging apparatus according to claim 2, wherein the oil degradation judging portion includes:

a residual lifetime ratio portion for calculating a residual lifetime ratio K(N) based on the formula:

$$K(N)=[L_{max}-L(N)]L_{max},$$

wherein $L_{max}$ is a maximum allowable degradation value and L(N) is a cumulative degradation value, and for storing the residual lifetime ratio; and an oil exchange alarm generation value portion for storing a predetermined oil exchange alarm generation value for judging whether or not an oil exchange alarm is given as compared with the residual lifetime ratio.

4. The engine oil degradation judging apparatus according to claim 3, further comprising a display device of judgment results to display judgment results, and including an oil exchange alarm in response to a judgment output.

5. The engine oil degradation judging apparatus according to claim 2, further comprising a display device of judgement results to display judgement results, and including an oil exchange alarm in response to a judgement output.

* * * * *